US008764572B2

(12) United States Patent
Nguyen et al.

(10) Patent No.: US 8,764,572 B2
(45) Date of Patent: Jul. 1, 2014

(54) REMOTE WAGER GAMING SYSTEM USING A VIDEO GAME CONSOLE

(75) Inventors: Binh T. Nguyen, Reno, NV (US); Brian Underdahl, VC Highlands, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 13/301,178

(22) Filed: Nov. 21, 2011

(65) Prior Publication Data

US 2012/0115584 A1 May 10, 2012

Related U.S. Application Data

(62) Division of application No. 11/593,434, filed on Nov. 6, 2006, now Pat. No. 8,079,905.

(51) Int. Cl.
*G07F 17/32* (2006.01)

(52) U.S. Cl.
USPC ..... 463/44; 463/42; 463/29

(58) Field of Classification Search
CPC ..... G07F 17/32; G07F 17/3241
USPC ..... 463/29, 42, 44
See application file for complete search history.

(56) References Cited

U.S. PATENT DOCUMENTS

| | | | | |
|---|---|---|---|---|
| 5,766,076 | A | 6/1998 | Pease et al. | |
| 5,768,382 | A * | 6/1998 | Schneier et al. | 380/251 |
| 6,035,400 | A | 3/2000 | Yasuoka | |
| 6,499,106 | B1 * | 12/2002 | Yaegashi et al. | 713/193 |
| 6,628,939 | B2 | 9/2003 | Paulsen | |
| 6,629,591 | B1 | 10/2003 | Griswold et al. | |
| 6,691,032 | B1 | 2/2004 | Irish et al. | |
| 6,716,103 | B1 | 4/2004 | Eck et al. | |
| 6,852,031 | B1 | 2/2005 | Rowe | |
| 6,865,551 | B1 | 3/2005 | Stefik et al. | |
| 6,896,618 | B2 | 5/2005 | Benoy et al. | |
| 8,079,905 | B2 | 12/2011 | Nguyen et al. | |

(Continued)

FOREIGN PATENT DOCUMENTS

| | | |
|---|---|---|
| EP | 1582241 | 10/2005 |
| WO | 03/027970 | 4/2003 |
| WO | 2004/025582 | 3/2004 |
| WO | 2005/043809 | 5/2005 |

OTHER PUBLICATIONS

U.S. Third-Party Submission dated Jul. 9, 2012 submitted in U.S. Appl. No. 13/301,178.

(Continued)

*Primary Examiner* — Corbett B Coburn
(74) *Attorney, Agent, or Firm* — Foley & Lardner LLP

(57) ABSTRACT

Gaming systems, devices, and methods are described for enabling wager gaming with a gaming operator using a game cartridge, such as a USB key, and game storage medium, such as a DVD. The cartridge and disc are inserted into a video game console and a connection with the gaming operator is made via the Internet. Once a connection is made and the identity of the game cartridge user has been verified and authenticated, the user can begin wager game play. Game play data are transmitted between the console and the gaming operator in an encrypted format. An encryption key is transmitted to the gaming operator via a digital certificate stored on the cartridge which has the corresponding private key. The game cartridge is capable of capturing a biometric sample of the user which is compared to a sample provided when the cartridge was issued to the user.

13 Claims, 8 Drawing Sheets

(56) References Cited

U.S. PATENT DOCUMENTS

| | | | | |
|---|---|---|---|---|
| 2002/0184500 | A1 | 12/2002 | Maritzen et al. | |
| 2003/0031321 | A1 | 2/2003 | Mages | |
| 2003/0032474 | A1 | 2/2003 | Kaminkow | |
| 2003/0054878 | A1 | 3/2003 | Benoy et al. | |
| 2003/0064805 | A1 | 4/2003 | Wells | |
| 2003/0073499 | A1 | 4/2003 | Reece | |
| 2003/0176218 | A1 | 9/2003 | LeMay et al. | |
| 2004/0092313 | A1 | 5/2004 | Saito et al. | |
| 2004/0209690 | A1 | 10/2004 | Bruzzese et al. | |
| 2004/0254014 | A1 | 12/2004 | Quraishi et al. | |
| 2004/0259633 | A1 * | 12/2004 | Gentles et al. | 463/29 |
| 2005/0054439 | A1 | 3/2005 | Rowe et al. | |
| 2005/0104835 | A1 | 5/2005 | Misonou et al. | |
| 2005/0124407 | A1 | 6/2005 | Rowe | |
| 2005/0130728 | A1 | 6/2005 | Nguyen | |
| 2006/0064577 | A1 | 3/2006 | Chiu et al. | |
| 2008/0015015 | A1 * | 1/2008 | Walker et al. | 463/29 |
| 2008/0076525 | A1 * | 3/2008 | Kim | 463/22 |
| 2010/0217992 | A1 * | 8/2010 | Hamlin et al. | 713/176 |

OTHER PUBLICATIONS

International Preliminary Report on Patentability dated May 12, 2009, from Application No. PCT/US2007/083768.

International Search Report and Written Opinion dated Sep. 11, 2008, from Application No. PCT/US2007/083768.

Partial Search Report dated Jun. 2, 2008, from Application No. PCT/US2007/083768.

Restriction Requirement dated Aug. 27, 2010, from U.S. Appl. No. 11/593,434.

Office Action dated Dec. 17, 2010, from U.S. Appl. No. 11/593,434.

Final Office Action dated Apr. 15, 2011, from U.S. Appl. No. 11/593,434.

Notice of Allowance dated Aug. 16, 2011, from U.S. Appl. No. 11/593,434.

* cited by examiner

REMOTE WAGER GAMING SYSTEM USING A VIDEO GAME CONSOLE

CROSS-REFERENCE TO RELATED APPLICATION

This application is a divisional of and claims priority to U.S. patent application Ser. No. 11/593,434, entitled "REMOTE WAGER GAMING SYSTEM USING A VIDEO GAME CONSOLE" filed Nov. 6, 2006, which has since granted as U.S. Pat. No. 8,079,905, which is incorporated herein by reference in its entirety and for all purposes.

BACKGROUND OF THE INVENTION

1. Field of the Invention

The present invention relates to systems, methods, and components for providing and playing wagering games. More specifically, it relates to remote wager gaming using video game consoles and online services provided by gaming establishments.

2. Description of the Related Art

As casinos, gaming establishments, and other entities in the wager gaming industry try expand their customer base, one approach they are taking is expanding the places and settings where patrons can play wagering games, specifically, outside of the casino and into traditionally non-wager gaming environments. One such environment they have contemplated has been the online, virtual world enabled by the Internet. Where allowed by law, more wager game players are using the Internet to register with gaming establishments' and gaming operators' Web sites to engage in wager game play.

A user may access wager gaming Web sites typically via a personal computer using a broadband connection to a gaming establishment Web server using a password and user name. However, the use of personal computers is problematic for various reasons. Generally, they do not provide a secure platform and can be manipulated and augmented fairly easily, thereby making cheating, tampering, and other foul play more viable for those with such intentions. In addition, PCs and the Internet, even with high-bandwidth broadband connections and computers with strong processing power and graphics capabilities, are generally not able to provide a "virtual" casino setting that has the immersive, varied, and high-sensory environment of a casino most gaming establishments would prefer that their online patrons experience. With present Internet technology and processing power of an average or even higher end PC, it is not generally practicable or technically feasible to offer the visual and audio clarity and other sensory elements to optimize the experience of real-time remote, wager gaming in a virtual casino environment. It would also be difficult to provide the security, such as player identification and authentication, that would be necessary to make remote wager game play with PCs acceptable to gaming establishments, law and regulatory enforcement agencies, and patrons.

Casino and gaming establishments would prefer to offer to its patrons a more secure, safe, immersive, and fulfilling experience of playing wagering games, whether over the Internet or in a stand-alone, non-network environment.

SUMMARY OF THE INVENTION

Novel systems, methods, and components for enabling wager game play using a video game console with a wager game cartridge and game disc are described wherein a user can use a video game console to engage in wager gaming for money or for practice and non-wager entertainment. A video game console typically including a console box and a game controller, can be used to play games of chance either in a "stand-alone" mode, where a user can play wagering games for practice or entertainment without monetary transactions or in an actual "wager gaming" mode, in which case the console makes a connection a gaming operator's Web site and monetary transactions are executed. In order to play wagering games in either mode on a video game console in one embodiment, a user first registers for or purchases a game cartridge and one or more wager game discs from gaming establishments, such as casinos, or a game provider (collectively referred to as "gaming operator"). The game cartridge has processing components, such as a CPU, a cryptographic engine, a biometric module among others, and data components for storing data on the user, the gaming operator, the cartridge itself, security and authentication, and other wager gaming and non-wager game specific data. The game disc, in one embodiment a separate component and intended to be a mass storage medium, has actual game code and logic for one or more specific wager games.

In one embodiment a game cartridge is in the form of a USB computing and storage device (also referred to as a USB key or "thumb drive") with a biometric sensor, such as a fingerprint scanner and can be inserted into a standard USB port. The game disc is a DVD-ROM, although a variety of other mass storage mediums can be used. Using one or both of these components in conjunction with a video game console and TV, powerful graphics, audio, and specialized processing capabilities of the console for playing (non-wager) video games can be leveraged to create an immersive, rich, and highly secure virtual casino environment for users to play wagering games. In one embodiment, a standard video game controller can be used to play the wager games or a specialized controller replicating the interface of various electronic gaming machines can be used.

The game cartridge and disc are inserted into a video game console via the primary console box or component, the controller, a personal computer, or, for the game disc, an optical disc reader or other peripheral. The cartridge and disc may be created and manufactured by or under the control of a gaming operator. In one embodiment, the game cartridge verifies and authenticates the user by utilizing a biometric device and can establish an online connection between the video game console and a gaming operator Web site. In one embodiment, data transmitted between the cartridge (via the video game console) and the Web site include wager game play data, pay table data, and other data related to game play. These data are encrypted using, for example, a cryptographic coprocessor in the cartridge and a digital certificate providing a name or identity of the cartridge and a public key, if public key infrastructure (PKI) is being used. In this case, the gaming operator that created the cartridge (which may be different from a gaming establishment or casino that only offers wager gaming and where the user may have a monetary account) may be a Certificate Authority, which the casino, gaming establishment, etc. can rely on to verify the authenticity of a certificate.

In one embodiment, a game disc contains code and logic for executing of the wager game creating a virtual casino environment with all the audio and photo-realistic visual effects a gaming operator may want its patrons to experience. In another embodiment this code is not present since it is not needed for actual game play, that is, it contains at least a gaming module or equivalent. The disc may also store video game console operating system data, as well as other data specifically for providing an immersive wager game play environment. Generally, as noted above, it is expected that the game disc be a mass storage device while the game cartridge not be used for storing massive amounts of code and data but rather for providing other specialized functions that enable wager game play. When used in the stand-alone mode, the game cartridge may not be necessary since data are not being exchanged with the gaming operator Web site, identity verifications and authentication are likely not required, no monetary transactions take place, and so on. However, the cartridge may be used for additional control and security when using the game disc, which may be desirable in some circumstances.

In one embodiment of the present invention, a wager gaming system is comprised of a wager game storage medium that has a pre-defined format created by a video game console manufacturer. The storage medium, such as a DVD-ROM contains a unique serial number which is created and placed on the storage medium by a gaming operator or under the control of a gaming operator. Also stored on the storage medium is wager game code for executing a wager game. The wager gaming system also comprises a wager game cartridge containing a digital certificate issued by the gaming operator. Stored on the game cartridge are operating system code enabling execution of the wager game code and wager game state data.

In some embodiments the wager gaming system includes a wager gaming server under control of the gaming operator for storing game play data and game cartridge data. In another embodiment the gaming system includes a video game console that operates with the game storage medium and the game cartridge to enable communication over a network with the gaming operator. In another embodiment the game cartridge of the wager gaming system includes a biometric sensor component. In yet another embodiment, the game cartridge has a cryptographic co-processor. In one embodiment the game cartridge is a USB device and the game storage medium is a DVD or other type of optical disc.

In another embodiment of present invention a method of playing wagering games over a network utilizing a video game console is described. A wager gaming server computer receives wager game system data over the network from a wager game cartridge operating through a video game console. The wager game system data includes user biometric data, a digital certificate, and a game cartridge identifier. The wager game system data are verified and user-specific data associated with the wager game system data are located. Wager game play data are transmitted over the network to the game cartridge. In one embodiment, the user biometric data are compared to previously obtained biometric data for a user. In another embodiment the wager game play data are encrypted using a public key provided in the digital certificate. In yet another embodiment the step of locating user-specific data includes accessing a user monetary account and player tracking data if available.

Another embodiment of the present invention is a programmable data storage component for use with an IP-enabled video game console to facilitate remote wager gaming provided by a gaming operator. The component comprises a CPU, a biometric sensor component capable of processing biometric data for transmission over a network, an identifier component for uniquely identifying the data storage component; and a digital certificate for communicating a public key to a third party using a public key infrastructure. A third party can use the public key to encrypt data transmitted to the data storage component. In one embodiment, the programmable component contains a private key for encrypting and decrypting data in conjunction with a cryptographic engine or co-processor also contained in the component.

In another embodiment of the present invention, a method of associating a user with a game cartridge is described. A biometric data sample is received from the user and the sample is stored in a data repository. A game cartridge having a unique identifier is issued to the user and the unique identifier is stored with the user's name. The biometric data sample is associated with the unique game cartridge identifier. In one embodiment, a digital certificate, containing a public key, is associated with the game cartridge and a corresponding private key is stored on the cartridge.

Yet another embodiment of the present invention is a wager game cartridge data repository storing video game console data that includes information on one or more data formats corresponding to proprietary data formats created by video game console manufactures, game cartridge data including user records, a user record containing a game cartridge identifier and a user name, and user biometric data containing user biometric data samples corresponding to users who have been issued a game cartridge. In one embodiment the repository includes digital certificate data which contains game cartridge identifiers and certificate authority identifiers.

The present invention provides hardware, such as game cartridges, that is configured to perform the methods of the invention, as well as software to control devices to perform these and other methods.

BRIEF DESCRIPTION OF THE DRAWINGS

References are made to the accompanying drawings, which form a part of the description and in which are shown, by way of illustration, specific embodiments of the present invention.

DETAILED DESCRIPTION OF THE INVENTION

Exemplary applications of systems, components, and methods according to the present invention are described. These examples are provided solely to add context and aid in the understanding of the invention. Thus, it will be apparent to one skilled in the art that the present invention may be practiced without some or all of the specific details described herein. In other instances, well-known process steps, system components, and software and network concepts have not been described in detail in order to avoid unnecessarily obscuring the present invention. In addition, other applications are possible, such that the following examples, illustrations, and contexts should not be taken as definitive or limiting either in scope or setting. Although the embodiments below are described in sufficient detail to enable one skilled in the art to practice the invention, these examples, illustrations, and contexts are not limiting, and other embodiments may be used and changes may be made without departing from the spirit and scope of the invention.

Wager gaming components and methods that enable video game consoles to be used for playing wager games either for money or only for practice and entertainment (i.e., without monetary transactions) are described in the various figures. Video game consoles, such as the Xbox 360, PlayStation, and Nintendo, have gained widespread popularity over the years. In the present invention, these consoles (which typically include a console box and a game controller) are utilized to allow users to connect to Web servers operated by gaming establishments, casinos, and/or game developers and providers (collectively "gaming operator") thereby enabling the users to engage in wagering game play or allows users to use the console as a stand-alone system to practice or play such games without placing real wagers. Thus, the wager gaming components of the present invention enable a dual use of a video game console with respect to wager gaming: wager game play with monetary transactions and wager game play without monetary transactions.

Figure 1:
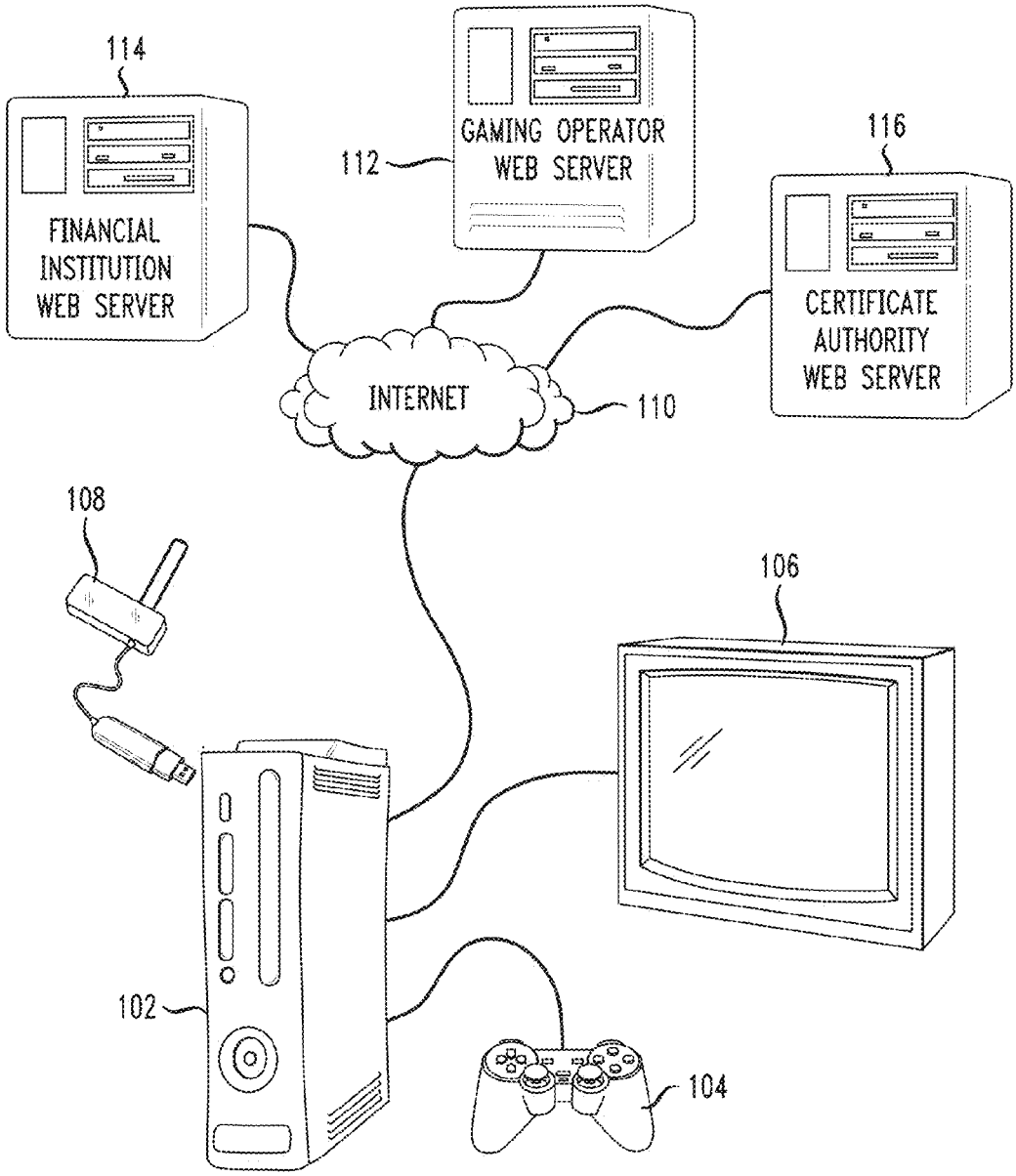
FIG. 1 is a diagram showing one configuration of a video game console set up that can be used to implement one embodiment of the present invention.

FIG. 1 is a diagram showing one configuration of a video game console set up that can be used to implement one embodiment of the present invention. A game console box 102 is connected to a game controller 104 and to a television 106. Game console 102 may also be connected to the Internet 110, preferably via a broadband or other high-bandwidth connection using, for example, a digital subscriber line (DSL) or a cable modem. This enables communication with components such as gaming operator Web server 112, a financial institution Web server 114, and a certificate authority Web server 116, all of which are described in greater detail below.

Game console 102 can also be connected to Internet 110 via other means (not shown) such as a personal computer, a server computer for use in a home network, or via any other IP-enabled device. Other components, such as various types of optical disc players and recorders, MP3 players, and so on can also be connected to console 102. Some connections can be wireless, utilizing the IEEE 802.11x standard, Bluetooth, and the like, via a wireless network adapter 108 attached to console 102. Other attachments and peripherals to either console 102 or controller 104 may include headsets and speakers. Video game consoles and associated controllers are available from various manufacturers including Microsoft Corp., makers of the Xbox 360, Sony Entertainment Corp., makers of the PlayStation series, and Nintendo Corp., makers of the Wii game console. There are numerous configurations of how video game console 102 and controller 104, as well as the numerous attachments and peripherals, can be set up. FIG. 1 shows one example configuration. Another common configuration has game console 102 connected to a PC. In this configuration, the PC monitor would likely be the display (although a TV may still be used) and the connection to the Internet is via the PC. The PC keyboard and other peripherals may comprise the game controller or game controller 104 can be used.

Video game console 102 may have Ethernet ports, controller ports, memory card slots, multi-purpose USB ports, and network connectors. In addition to having one or more CPUs, console 102 may have one or more graphics processing units (GPUs) operating at a certain core frequency, such as 500 MHz. The one or more GPUs may have dedicated shader control flow units, custom high-speed EDRAMs, and use vector and scalar ALUs for shading. The audio capabilities of console 102 may provide ambient environment sounds that are instinctual, immersive and varied. For example, console 102 may use hundreds of independent compression channels and 32-bit audio processing, enabling audio set ups such as 5.1 Digital Surround Sound. The console may provide widescreen formatting (16:9 ratio) and 480 or 720 progressive scans when high-definition televisions are used as displays. Capabilities such as these and others enable video game console 102 to provide visual flair and a photo-realistic environment for a virtual casino and games played through the console.

In some embodiments, video game controller 104 may also have Ethernet ports, USB connectors, network connectors, and expansion slots for memory cards, smart cards, and so on. Controller 104 is preferably designed to give users control, comfort, and pinpoint accuracy during use. Some controllers include multiple analog buttons, pressure-point triggers, multi-way directional pads, and menu navigation buttons. Some also have vibration feedback motors. In addition, specialized and non-standard controllers can be used with console 102. For example, a controller that resembles the interface of an electronic wager gaming machine can be used either alone or in conjunction with standard game controller 104. Other embodiments of a controller may include a simple player-input button arrangement with a pull handle, intended to replicate the user experience of playing an electronic gaming machine. For example, such an arrangement can have buttons for "Bet Max", "Cash Out", "Bet One", "Repeat Bet" and so on. In another embodiment, the controller is in the form of a tablet-type touch screen interface where a user can touch sections of the tablet screen that have analogous coordinates that correspond to areas on the television or computer monitor. Other embodiments of controller 104 include a keyboard interface for entering data, such as player tracking information, or be a smaller PDA-type controller. In other embodiments, the controller has controls enabling multiple players to operate game console 102 concurrently.

Game console 102 and controller 104 may also have various types of ports and connectors for optical disc drives capable of reading DVDs and CDs, including audio CDs, DVD-R, DVD-RW, and other proprietary formats such as Blu-ray and HD-DVD discs. Other types of memory storage devices that may be operable with console 102 and controller 104 include memory cartridges and flash cards, utilizing VC1 compression technology and MPE2 technology, thereby enabling high quality video.

As the above descriptions suggest, video game consoles are designed and built for the primary purpose of playing video games. They are intended to provide the user with an immersive experience of sound, graphics, and physical sensation (e.g., a game controller may be configured to shake and vibrate in the user's hands). They are not intended for use as general computing devices as are PCs. The features and capabilities described above make video gaming consoles very well-suited for providing users with a photo-realistic and high-sensory environment to play wagering games, whether for practice or for real-time, actual wager game play involving monetary transactions.

Figure 7:
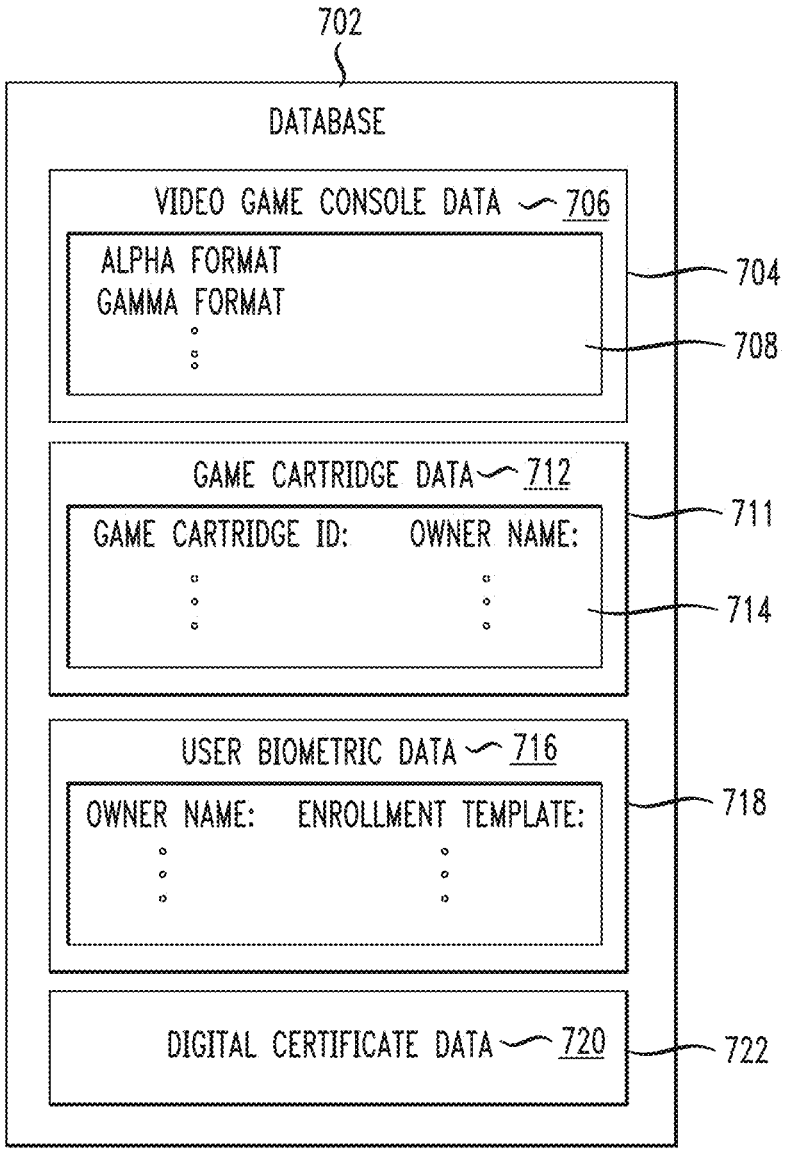
FIG. 7 is a block diagram of a database under control of a gaming operator for storing data used in implementing some embodiments of the present invention.
Figure 8:
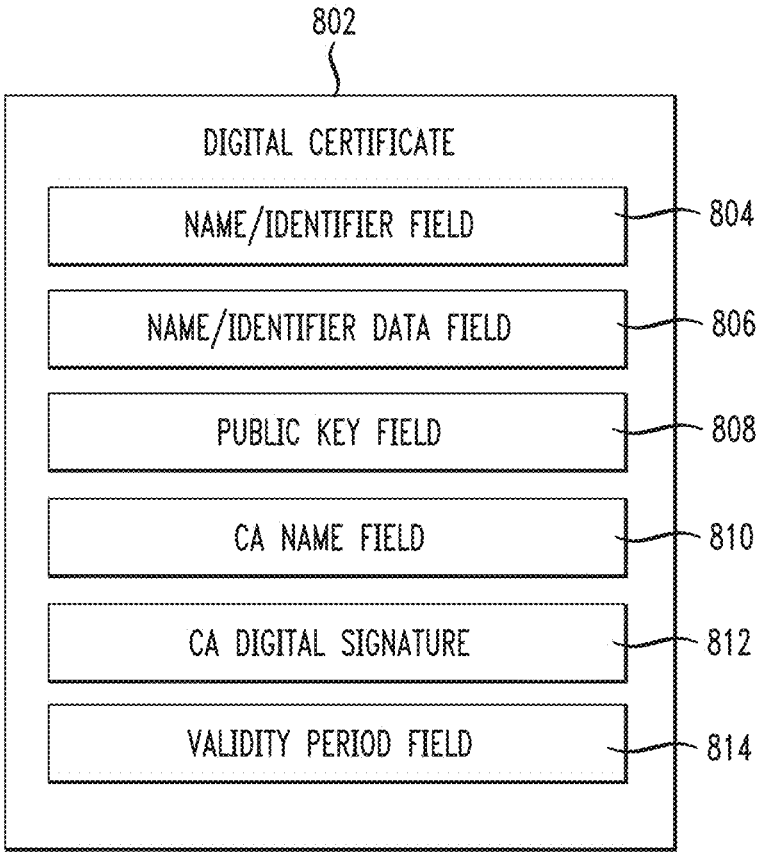
FIG. 8 is a block diagram showing a data format of a digital certificate used in implementing some embodiments of the present invention.
Figure 9:
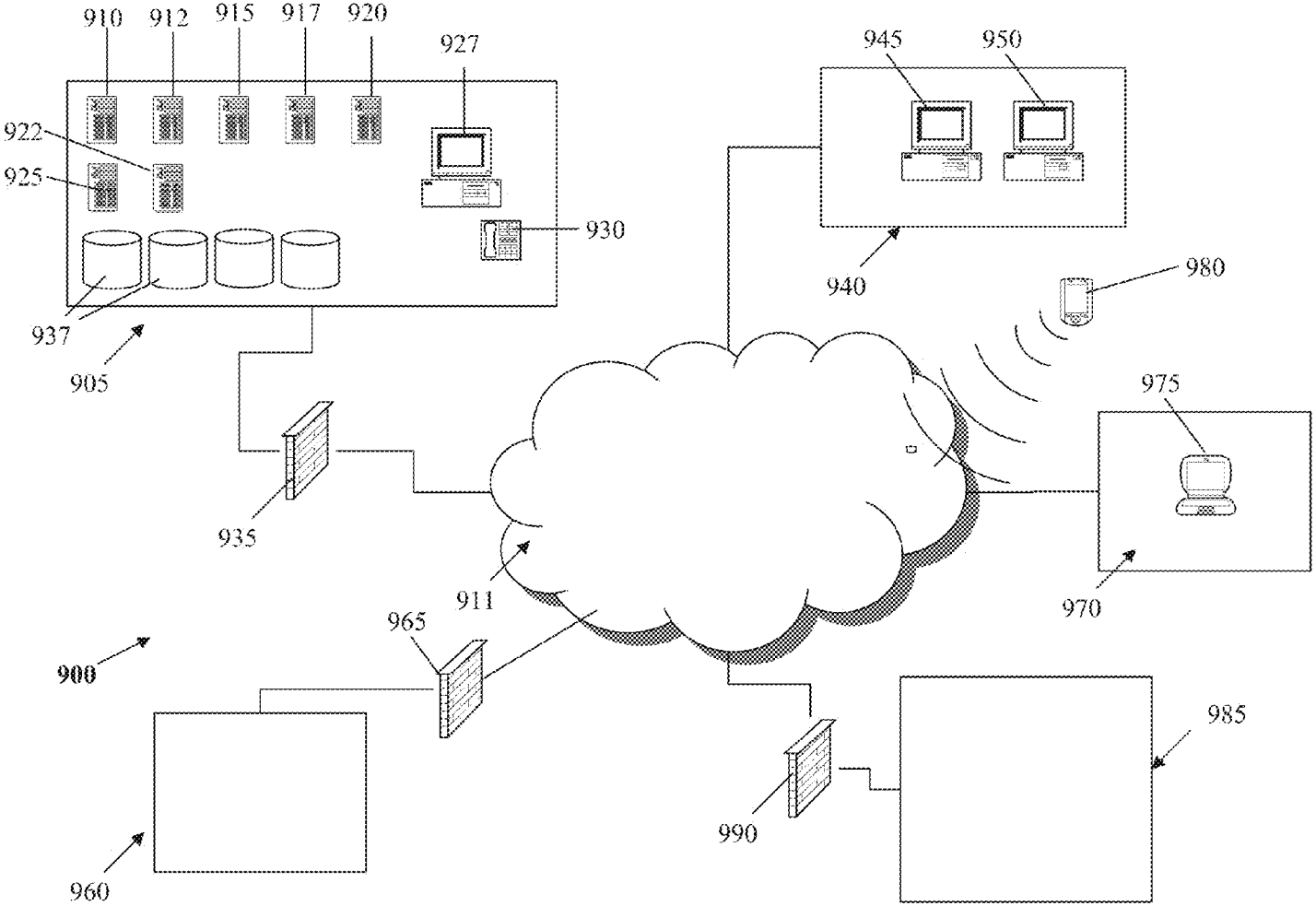
FIG. 9 illustrates one example of a gaming network topology for implementing some embodiments of the present invention.

Actual wager game play will involve communication with gaming operator Web server 112 and certain components of a gaming network (not shown), such as database 702 described in FIG. 7 and other network storage components and devices shown in FIG. 9. Another entity that may be required is financial institution 114 for managing and holding a user's monetary account. This function may also be performed by a gaming operator. However, in some embodiments, a separate financial entity, such as a bank, manages and provides funds for wager game play to the user and makes monetary transfers to and from the gaming operator as required based on the user's winnings and losses. Also shown is certificate authority (CA) Web server 116 that issues digital certificates, such as the one shown in FIG. 8. In the described embodiment, the gaming operator is the certificate authority as described below. In other embodiments, there may be a separate entity (operating Web server 116) that performs CA functions as well as registration authority functions.

Figure 2:
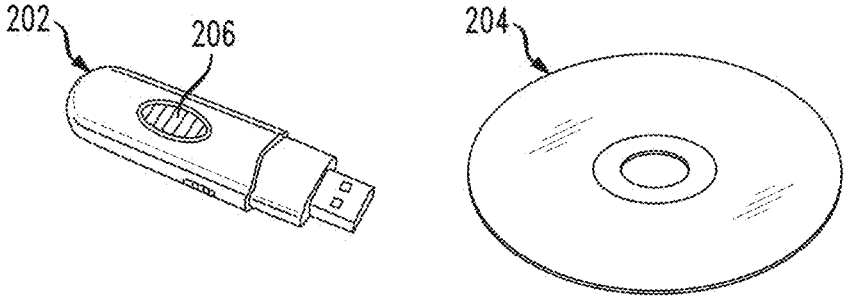
FIG. 2 shows a game cartridge 202 and game disc 204 in accordance with one embodiment of the present invention.

In the described embodiment, video game console 102 interacts with one or two separate wager gaming components depending on which mode of game play is desired. FIG. 2 shows a game cartridge 202 and game disc 204 in accordance with one embodiment of the present invention. Game cartridge 202 is a storage and computing device that stores and processes data relating to a user, a gaming establishment, security and authentication, and other aspects of the system. In the described embodiment, gaming cartridge 202 is not considered a mass storage device and generally does not contain game code for a specific wagering game. In another embodiment, game cartridge 202 may be a mass storage device and may store all the game code and logic needed for executing a wagering game. In the described embodiment game cartridge 202 is in the form of a USB storage device, also referred to as a USB key or thumb drive, having a biometric sensor, such as a finger print reader 206 shown FIG. 2. In another embodiment, game cartridge 202 may be in the form of a virtual PC, such as the LivePC Engine, from moka5 of Redwood City, Calif., implemented in a USB key. In another embodiment game cartridge 202 can be on a U3 smart drive which is well suited for storing programs and software. In another embodiment, a device, such as a flash drive, removable hard drive, MP3 players, and so on, can store Portable Apps that can be used to implement some or all of the components and software described below.

Game code and logic for a specific game are contained on a separate mass storage medium shown as game disc 204, such as a DVD or other optical disc shown in FIG. 2. In other embodiments, other storage devices operable with game console 102 and controller 104 can be used such as memory cards, memory sticks (from Sony Corp.), portable hard drives, and so on. In yet another embodiment, data can be communicated to and accessible by console 102 or controller 104 via a wired or wireless network.

Figure 3:
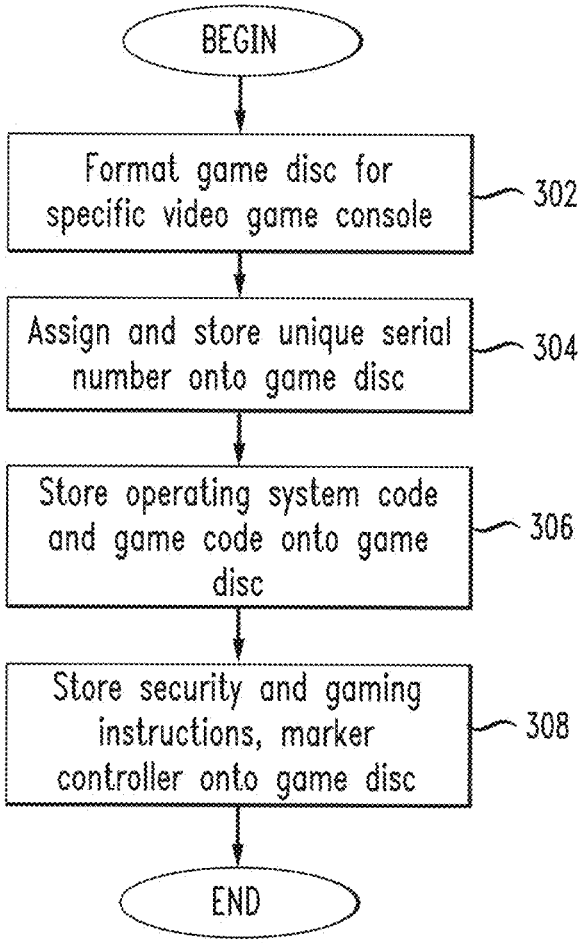
FIG. 3 is a flow diagram of a process of creating game disc 204 in accordance with a described embodiment of the present invention.

FIG. 3 is a flow diagram of a process of creating game disc 204 in accordance with a described embodiment of the present invention. Steps of the method shown and described herein need not be performed (and in some implementations are not performed) in the order indicated. Some implementations of this method may include more or fewer steps than those described. The flow diagram describes a process of creating game disc 204, for example a DVD containing game code (also referred to as a binary image or module) for one type of game. Game code for a wagering game may be in the range of 500 Mbytes. The code for graphically creating a virtual casino which may be present on game disc 204, can also be in the megabyte to gigabyte range.

Most video game consoles, such as the Xbox 360 or PlayStation, operate on media having protocols and formats proprietary to the manufacturer of the game console, such as Microsoft or Sony. One proprietary feature is often a specific data format. Such a proprietary format enables data contained on a storage medium to be read only by the appropriate video game console. For example, a game console may use a proprietary data format called ALPHA. At step 302, game disc (or other storage medium) is formatted so that it can only store data in the ALPHA format. In the described embodiment, the game disc is a DVD. In other embodiments, the storage medium may be a USB memory device, a Memory Stick, a CD, a Blu-ray disc ("BD-Video" disc) or HD-DVD disc. The formatting and preparation of the storage medium can be done by an entity that has knowledge of the proprietary format (e.g., ALPHA) which would normally be provided by the video game console manufacturer. The entity performing the formatting can be, for example, a game developer and provider, a gaming establishment, or casino. In another embodiment, it can be done by the video game console manufacturer and then provided to third parties.

At step 304 the gaming operator assigns a unique serial number or identifier to the disc and stores it in a permanent manner on the game disc. In the described embodiment, the unique serial number for a DVD game disc formatted and intended for use by an ALPHA video game console may have a serial number that starts with "AL" such as AL5689. Serial numbers for discs to be used on a GAMMA video game console may have a serial number that begins with GMxxxx, and so on. Many other serial numbering techniques or schemas can be used to uniquely identify a storage medium for a specific video console manufacturer.

At step 306 the gaming operator stores operating system code and game code on the game disc. Operating system code (which may be developed, e.g., by the gaming operator) is used to execute the game code. In the described embodiment, the operating system is proprietary to the gaming operator and is developed by the gaming operator for a specific video game console. The game code may be a binary game module created from compiling and linking source code. It contains code needed to execute a particular wagering game. It may also contain code for graphics, sound, pay table, and other features.

At step 308 several types of data and instructions are stored on the game disc. They include data relating to security and auditing functions. Also stored on the game disc is master controller code. In the described embodiment, this code works directly with game cartridge 202 and generally directs cartridge 202 and game code logic stored on game disc 204 to run or execute specific modules at the appropriate times.

In the described embodiment a user can utilize the game disc or storage medium created in the process described in FIG. 3 in one of two modes. One mode can be referred to as a "stand-alone" or "non-transactional" mode. In this mode, the user's video game console does not connect with a gaming operator via the Internet or other network. No actual monetary transactions take place between the user and the gaming operator. For example, a user can use stand-alone mode by inserting a game disc 204 and practice playing the wager game stored therein. In the described embodiment, disc 204 has all the necessary components such as a pay table, operating system, and game logic code (binary image) to enable a user to play the game, make wagers, and see winnings and losses without there being any actual monetary transactions. In another scenario, because there is no real wagering or transactions with a gaming operator, the wager game can be played for entertainment and practice in jurisdictions or geographic locations where wager gaming is prohibited by law or regulation.

Another mode can be referred to as a wager gaming mode. In this mode the user is able to play the wagering game stored on game disc 204 for actual monetary wins and losses. In the described embodiment, upon insertion of game cartridge 202, a connection is made with a gaming operator via the Internet or other public or private network, such as a VPN. Upon a connection being established, and other security processes being completed, the user's monetary account (and, in some implementations, player tracking data) are accessed and adjusted based on game play. When a user plays in this mode, for example, an experience is provided similar to that of physically sitting at an electronic gaming machine and playing a wagering game at the casino or gaming establishment run by the gaming operator.

In the described embodiment, to enable wager gaming mode, the user inserts, as noted above, game disc 204 and game cartridge 202 into gaming console 102. A game cartridge may be issued to a user by a gaming operator such as a casino or a wagering game producer, such as IGT of Reno, Nev.

In addition to being issued to and intended for use by a specific, authorized user (e.g, one who is of a certain age, has a monetary account with the issuer, whose identity has been verified, and so on), a game cartridge may also be specifically designed for a particular video game console. Although most video game consoles are able to read data from various portable storage mediums and computing devices, connectors, or ports, inputs to a console may not use a standard or universal connector for a particular medium, as would normally be expected with a PC, for example. Thus, a USB 2.0 input or a IEEE-1394 (Firewire) input on a video game console may not be the standard USB or Firewire input but rather a proprietary input developed by the console manufacturer. One reason for this may be to prevent users from inputting or injecting any type of data or computations into what are generally tightly-controlled and guarded hardware and software platforms. By requiring that a storage medium, such as a USB key, have a console-specific connector, the manufacturer can control third-party or user access to the internals of the system.

Figure 4A:
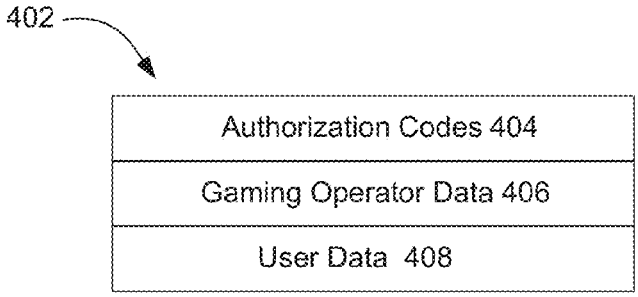
FIG. 4A is a diagram showing an overview of data modules in a game cartridge in accordance with one embodiment of the present invention.
Figure 4B:
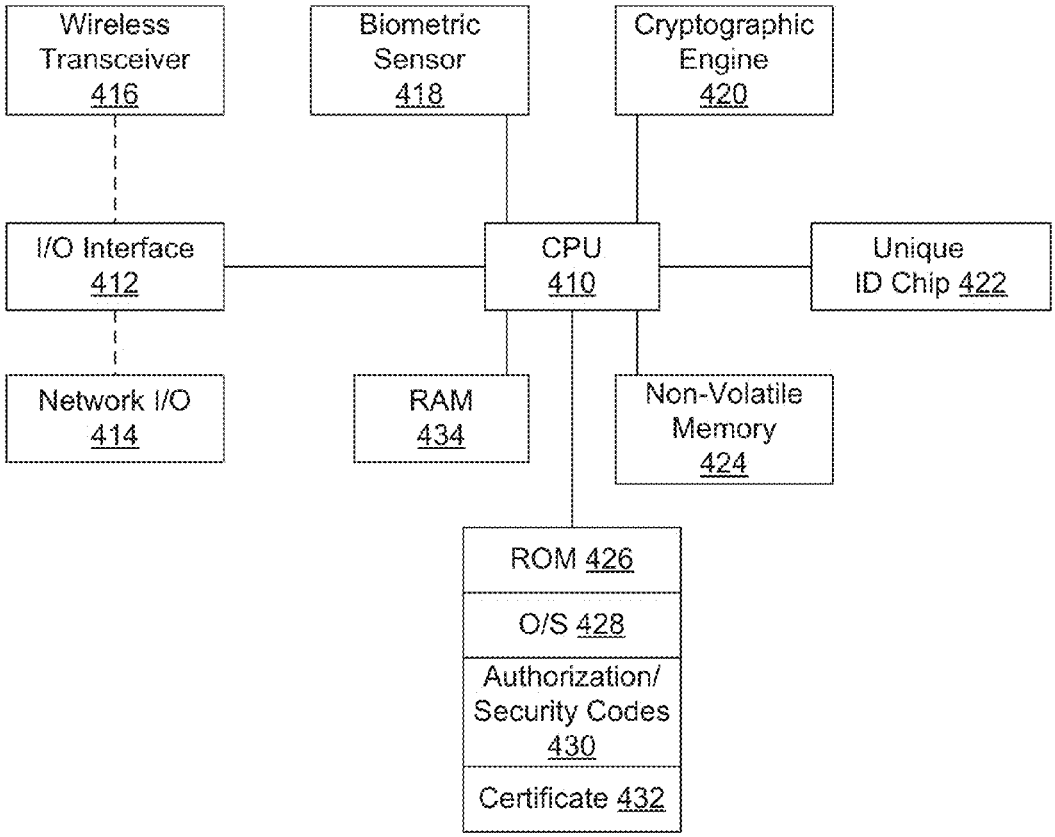
FIG. 4B is a block diagram showing processing components and modules of a game cartridge in accordance with one embodiment of the present invention.

FIG. 4A is a diagram showing an overview of data modules in a game cartridge in accordance with one embodiment of the present invention. A game cartridge has numerous data and computing components, as shown in FIG. 4B below, among them various types of memory. A game cartridge 402 has stored in these memory areas authorization codes 404 that are used to authorize online wager game play by the user. Authorization codes 404 check for general integrity and authenticity of the console. Also stored in game cartridge 402 are gaming operator data 406. These data relate to the gaming operator and are needed to establish an online connection between a video game console and the gaming operator's Web server(s). Also included are user data 408 stored on cartridge 402 at the time the cartridge is issued to the user. Data 408 may be used by the gaming operator to identify the user of the cartridge, along with biometric data as described below, and proceed accordingly. For example, the gaming operator can examine the user's account to determine whether there are sufficient funds to engage in wager game play using the video game console.

FIG. 4B is a block diagram showing processing components and modules of a game cartridge in accordance with one embodiment of the present invention. A game cartridge has at least one processing unit, shown in FIG. 4B as a CPU 410. An I/O interface 412 controls input and output of data to the game cartridge and regulates data traffic generally. Input/output interface 412 enables input from a network I/O component 414 or a wireless transceiver 416. In another embodiment, input and output to CPU 410 can be direct from wireless transceiver 416 or network I/O component 414. This embodiment may provide a more secure process of providing and transmitting data from CPU 410 while possibly sacrificing processing time for non-core functionality (i.e., one that can be off-loaded).

Another component connected to CPU 410 includes a biometric sensor component 418, such as a fingerprint scanner component. As noted above, game cartridge 402 is issued to a specific user by a gaming operator. The biometric sensor component 418 enables the gaming operator to verify and authenticate a user of the game cartridge. At some point in the process of issuing a game cartridge to a user, the user provides biometric data to the gaming operator. In the described embodiment, these data are a fingerprint scan. In other embodiments these data can include iris scans, retinal scans, facial contours, voice samples, and so on. The biometric reading provided at issuance may be referred to as an enrollment template which is stored by the gaming operator. In one embodiment, these enrollment templates, along with other user data, are stored at a database 702 shown in FIG. 7.

Biometric sensor component 418 collects biometric data of the user and communicates the data to CPU 410. Biometric sensor component 418 manages and collects data relating to biometric verification of the user.

In the described embodiment, before a game cartridge is used the user submits a fingerprint scan which comprises a verification template which is hashed and sent to the gaming operator. The gaming operator uses a biometric API and system to perform a one-to-one comparison of the verification template with the enrollment template for that user to verify and authenticate the identity of the game cartridge user. As described in greater detail below, if the templates match, the gaming operator has verified and authenticated that the user is the registered user of the game cartridge. At this stage, the user's monetary account may be accessed, player tracking data retrieved, and a transactional mode connection can be established between the gaming operator and the video game console.

Once a connection is established between a game cartridge (via the video game console) and a gaming operator Web server, game play data, including data on wagers, payouts, and other sensitive information, are transmitted between the console and the Web server in an encrypted form. In the described embodiment, a cryptographic coprocessor or engine 420 executes in conjunction with CPU 410. As is well known in the field of data communications and processing, encrypting and decrypting data can be computationally heavy tasks. Thus, it is generally preferable that encryption and decryption processes be separated from general processing tasks of a CPU and be delegated to a dedicated coprocessor. In addition, cryptographic coprocessor 420 can also perform DES, 3DES, AES, and other public key infrastructure (PKI) cryptography functions in a highly secure environment which can withstand physical tampering and logical attacks. Coprocessor 420 can also retrieve or be given a certificate, described below, or any other data, and perform all the necessary self-authentication and verification functions with the gaming operator, (e.g., handshaking operations) thereby relieving CPU 410 of these tasks. Examples of such cryptographic engines include the IBM 4764 or 4758 cryptographic coprocessor. In other embodiments, some or all of these functions can be performed by CPU 410 or other suitable co-processors (not shown). In yet other embodiments, cryptographic engine 420 is not needed and all cryptographic functions are performed by CPU 410.

A game cartridge may also have a unique identifier that is stored in a secure ID chip 422. In the described embodiment, chip 422 is fixed to the cartridge and securely stores an identifier unique to the gaming operator issuing the game cartridge. Chip 422 cannot be written to or erased. It is generally more secure than a ROM, which can be tampered with or replaced.

A non-volatile memory 424, such as a flash memory, can store various items of data on wager game play and management. In the described embodiment, non-volatile memory 424 (memory that can be written to and continue to store data when power is shut off) can have writeable and secure sections (not shown). Data items stored in memory 424 can include wager game states, including information on status, progress, statistics for player tracking, and the like. More generally, memory 424 also stores state data (data on the state of wager game play) that would enable a user to re-start a game in the event of an unexpected interruption, such as the power shutting off or the Internet connection being disabled. Preferably, state date for waging game sessions are also stored in another location by a gaming establishment or the like.

These data can also include game statistics, game history, statistics for player tracking, licensing information, expiration data and so on. In one embodiment, game state information is stored in a secure section of non-volatile memory 424. In another embodiment, a writable section may store game history data. It can also store user identifier information (e.g., a user ID) and various other identifying information pertaining to other aspects of the system. For example, a user ID can be installed on non-volatile memory 424 when game cartridge 402 is issued to or bought by a user. In another embodiment, all identifying information can be stored in a special, writeable section of non-volatile memory 424.

Game cartridge 402 also contains a ROM 426 for storing various types of data relating to wager game play operation and security. In order to enable wager game play, whether in "stand-alone" mode or "wager gaming" mode, game cartridge 402 may need an operating system 428 to manage the various functions performed by cartridge 402, which functions as a miniature wager gaming subsystem that operates in conjunction with the game disc to enable wagering game play. Operating system 428 may be a core-level version of an operating system that may normally be installed, for example, on an electronic gaming machine. In the described embodiment, operating system 428 manages the operation of game cartridge 402 itself. For example, operating system 428 may run the network I/O component 412 and 416 and wireless transceivers 416. Managing drivers is a normal activity of operating systems but this task will likely not be needed with cartridge 402, which may have pared-down drivers rather than conventional drivers. In a described embodiment, game cartridge 402 does not load operating system 428 onto the video game console. In other embodiments, operating system 428 may be temporarily installed on console 102.

ROM 426 may also store various authorization and security codes 432. It can include a private key to decrypt data. In the described embodiment, ROM 426 also stores one or more digital certificates 432, such as a public key certificate, described in more detail in FIG. 8. Certificate 432 may be used to verify that a public key (provided on the certificate) belongs to an entity, such as an individual, a company, or physical object, such as a game cartridge, computer, or PDA. When connecting to a gaming operator Web server via the Internet, a game cartridge, which has an identity, characterized at least in part by the unique identifier stored on ID chip 422, may be required to prove its identity to the gaming operator before the gaming operator's online system continues to communicate with the game cartridge (via the game console). That is, the gaming operator wants to ensure that the game cartridge be verified and authenticated given that the operator will henceforth enable real-time wager gaming in an online environment with actual monetary transactions. This will normally require accessing a user's financial account and making debits and credits. It also important because of various gaming regulatory requirements, player tracking, and so on.

Certificate 432 can be used to verify the identity of a game cartridge and to transmit to the game cartridge, data that can be decrypted by the cartridge. In the described embodiment, certificate 432 has a unique identifier (its "name") and contains a signature which is intended to be read by the gaming operator who receives certificate 432. For example, a cartridge may have a unique identifier of "XU48bm" which represents the cartridge's name. In the described embodiment, the digital signature that cartridge XU48bm is making public is the cartridge's ROM signature which is a fixed signature or identifier unique to ROM 426. In other embodiments, other data items can be used as the signature, including the cartridge's unique identifier contained in ID chip 422. In one embodiment, it would be preferable if the name was not also the unique identifier but rather another data item or combination of data items unique to the chip.

The primary data item on a certificate 402 is the public key that belongs to the cartridge, e.g, XU48bm. However, as in other public key infrastructures, the gaming operator may not trust digital certificate 432 that it receives from the game cartridge. Hence the need for a certificate authority. For example, another game cartridge may have sent a certificate claiming it is game cartridge XU48bm and that the public key on the certificate is its new public key. Thus, a gaming operator needs a trusted third-party, referred to as a certificate authority, to tell the operator that the certificate it receives is authentic and that the public key on the certificate is genuine for the game cartridge identified on the certificate. Upon receiving this assurance, the gaming operator can safely use the public key in the certificate to encrypt data, which may include sensitive information, such as payout data, monetary data, data from a random number generator and so on, and transmit them to the game cartridge via the video game console. In the described embodiment, cryptographic engine 420 can then decrypt the data and perform other verification and authentication routines.

Working in conjunction with a certificate authority is a registration authority which verifies the identity of the user or owner of the game cartridge when it is issued. In this case the gaming operator is also the registration authority in that it verifies the name, address, date of birth, etc. of the person buying the game cartridge and is in a sense the owner of the digital certificate contained in the game cartridge. The certificate authority may revoke the certificate if the private key (stored in memory area 430) has been comprised using a certificate revocation list ("CRL") maintained by the gaming operator. A gaming operator can check certificate validity by querying the certificate authority using an online certificate status protocol ("OCSP") or other standard, such as XKMS.

In the described embodiment, a gaming operator is the certificate authority for certificates used in game cartridges manufactured by that gaming operator. For example, a wager game developer, that is, the entity that creates the wager games stored on the game discs is a certificate authority. In one scenario, IGT of Reno, Nev., a wager game producer creates a game and installs it on a DVD or other medium (as described in FIG. 3) for play on a video game console, such as an Xbox 360 or PlayStation 2. IGT may also create the software, data, and components that go on game cartridges (it may also manufacture the cartridge itself). A user buys the IGT game DVD and game cartridge from a casino or gaming establishment which may be different from IGT. The game cartridge is configured at the time the user buys it. For example, the casino may collect biometric data of the user (the enrollment template), verify the user's identity (act as a registration authority), open a user account for monetary transactions, install a user ID on the cartridge, and so on.

Unique ID chip 422 on the cartridge already has IGT's unique identifier stored in it. The cartridge may also have a certificate 432 that has a unique identifier representing the identity or unique "name" of the cartridge. The certificate also has a public key conforming to certain standards which is assigned to it by IGT. When the user inserts the game cartridge and DVD into a console to enable real-time wagering game play, the certificate is sent to the casino that sold and issued the certificate to the user (game DVDs may have been bought then or at a later time). The casino will not send certain categories of data back to the user unless those data are encrypted. The casino can use the public key on the certificate, as described above, but may first verify that the data on the certificate is authenticate, specifically that the public key on the certificate is in fact for the game cartridge identified on the certificate. In this scenario, the casino would prefer to have a certificate authority verify that the certificate is valid and authentic. In this case IGT is the certificate authority. The casino checks with IGT to make sure the certificate is authentic and can attest that the public key on the certificate belongs to the game cartridge identified on the certificate. This check by IGT or other certificate authority provides an additional level of control over the data transmitted between the casino and the game cartridge. In another embodiment, a user buys the game cartridge and game DVD directly from IGT and bypasses the casino. The user can then use the cartridge in a game console to play wagering games by connecting to a casino or other gaming establishment having an operational relationship with IGT. In other embodiments, conventional certificate authorities, such as VeriSign of Mountain View, Calif. or Entrust of Addison, Tex., can perform as certificate authorities in the wager gaming environment described above.

The public key or other encryption key that the game cartridge makes public via certificate 432 may have to conform to known encryption standards. However, the name or identity of the cartridge need not and can be assigned by the manufacturer. In another embodiment, the name/identity can be assigned by the casino or gaming operator issuing the cartridge. In this embodiment, it would be preferable if there is close coordination between the casino and the certificate authority. Most or all of the encryption routines and operations can be executed by cryptographic engine 420 which has access to the private key used to decrypt data received from an external source.

Figure 5:
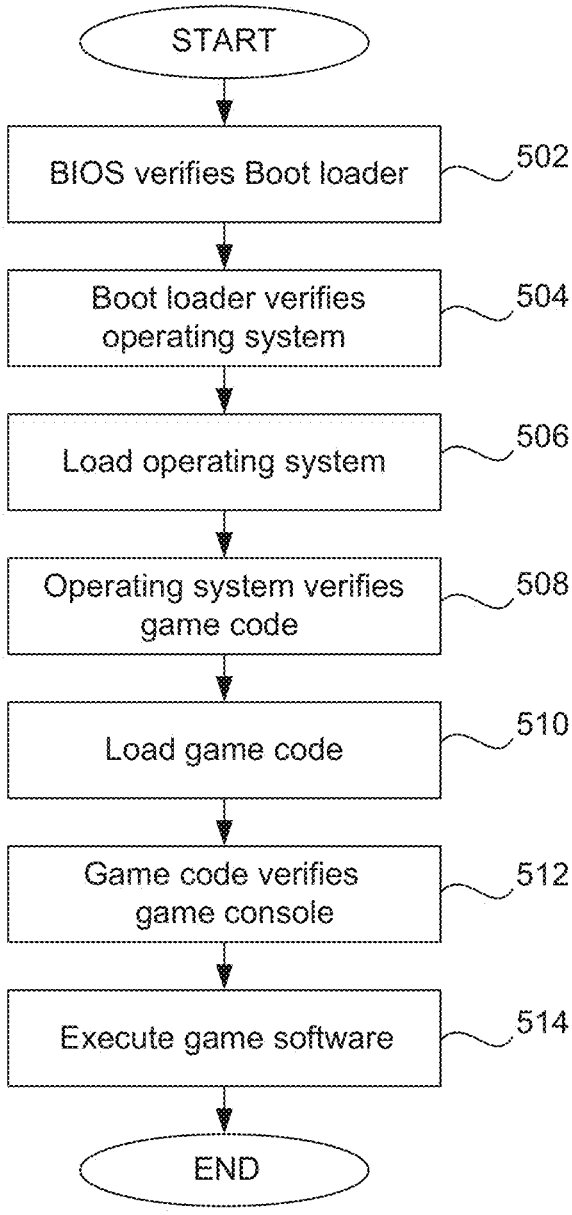
FIG. 5 is a flow diagram of a self-authentication process performed by a game cartridge in accordance with one embodiment of the present invention.

FIG. 5 is a flow diagram of a self-authentication process performed by a game cartridge in accordance with one embodiment of the present invention. Steps of the method shown and described herein need not be performed (and in some implementations are not performed) in the order indicated. Some implementations of this method may include more or fewer steps than those described. A game cartridge may be required to verify to itself as well as external components that it is a trusted component. In the described embodiment, a game cartridge may also authenticate its operating system and load software from the game DVD. At a step 502 the BIOS, a trusted system of game cartridge CPU 410, verifies the boot loader. At step 504 the game cartridge boot loader verifies and loads operating system 428. The operating system is loaded into RAM 434 or ROM 426 from the game DVD at step 506. The game cartridge operating system verifies the game code on the game DVD at step 508. At step 510 the game code is loaded onto the game console memory. At step 512 the game code loaded at step 510 verifies the game console, controller, and peripherals. Once the game console is verified as a functioning and authentic console by the specified manufacturer, the wager game can execute on the video game console at step 514 and the self-authentication process of the game cartridge is complete.

It is now useful to describe a method of using a game disc and game cartridge of the present invention for wager game play utilizing a video game console. As described, a user may use a game DVD by itself in stand-alone mode in which no connection with a casino or gaming operator is necessary. In this mode no data are transferred over the Internet or other public network, although a home or other small-scale private network may be utilized. For example, a user can practice playing a wager game without making actual monetary transactions or play for entertainment without any intention of engaging in actual wagering. The other mode is for actual wager game play in a virtual casino where monetary winnings and losses are real. A gaming operator will likely require that the user and video game console physically be in a jurisdiction that allows wager gaming.

Figure 6:
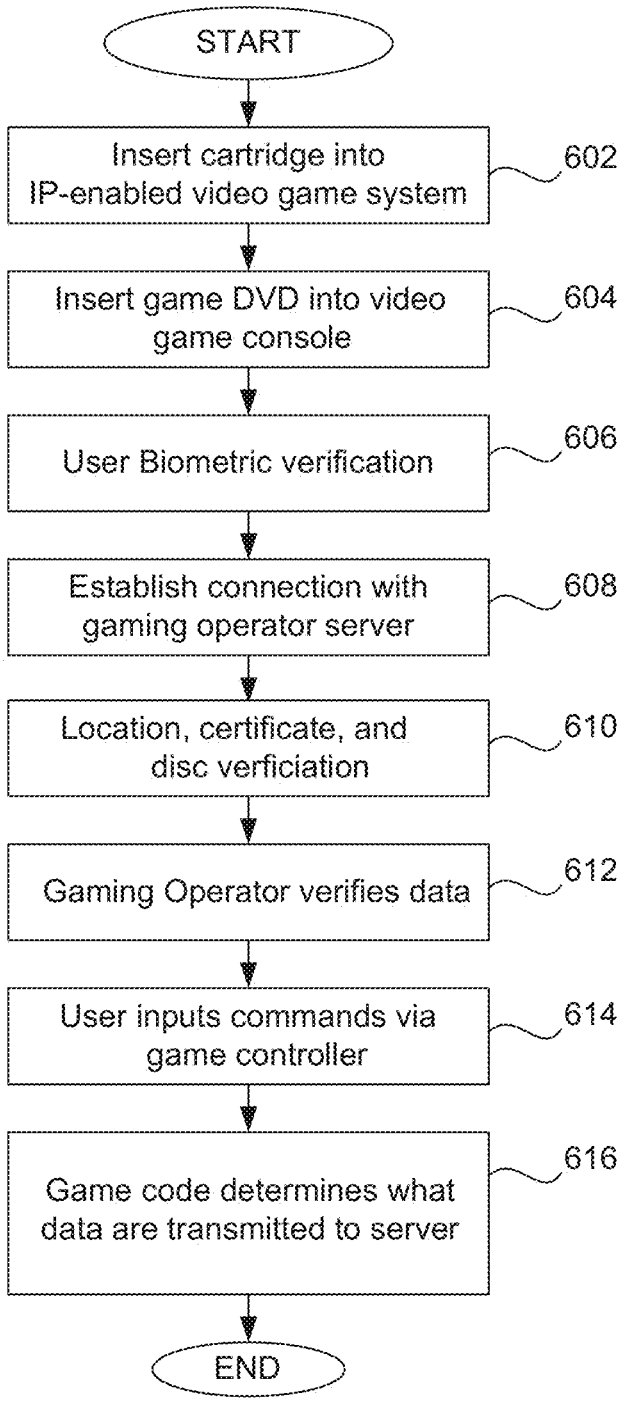
FIG. 6 is a flow diagram of a process of playing wagering games using a video game console and components of the present invention.

FIG. 6 is a flow diagram of a process of playing wagering games using a video game console and components of the present invention. Steps of the method shown and described herein need not be performed (and in some implementations are not performed) in the order indicated. Some implementations of this method may include more or fewer steps than those described. At step 602 a game cartridge is inserted into a video game console or controller. In another embodiment, the cartridge is inserted into a PC connected to a console. As described above, the game cartridge may use a known platform or standard such as Universal Serial Bus (USB) or FireWire but may have a connector that is proprietary to a particular video game console. In another scenario the user may have a connector converter that accepts a standard USB or FireWire input on one end (for the game cartridge) and a console-specific connector on the other for insertion into the console. Such a connector converter may be given to the user when buying or registering for the game cartridge at which time the user can specify which video game console will be used and get the appropriate connector.

At step 604 a game DVD is inserted into the video game console. This can be done before or after insertion of a game cartridge at step 602 and can be inserted in the console, controller, a PC, or external optical disc reader connected to and operating in conjunction with the game console.

At step 606 a biometric sample is provided by the user and verified by the gaming operator. In the described embodiment, a biometric sensor is embedded in the game cartridge. For example, a fingerprint scanner area may be accessible to the user of the game cartridge as shown in FIG. 2. The user can apply the appropriate finger or thumb on the reader and use a controller or biometric API to transmit the biometric data over the Internet to the gaming operator. The gaming operator checks the sample or verification template against the enrollment template for that user, which it had stored when the user initially registered for or bought the game cartridge. If the data matches, the user's identity is verified and authenticated and the process continues. In other embodiments, a user's biometric sample is stored in the game cartridge. This enables a user to use the game cartridge even if in "stand-alone" mode and ensure that the owner or registered user is using the device.

In other embodiments, other types of biometric sensors can be used to verify the identity of the user. A biometric sensor may be embedded in the game cartridge or may be a separate device that operates in conjunction with the game cartridge. For example, a biometric device with a connector suitable for use with the game console may be used to transmit user biometric data to a gaming operator, followed by insertion of a gaming cartridge. Various methods of associating a biometric sample from a sensor and transmitting the data to the gaming operator can be used with the present invention. In the described embodiment, a fingerprint verification template is hashed and transmitted to the gaming operator.

Once the user has been authenticated and verified with the gaming operator, at step 608 the game console establishes a connection between the video game console and the gaming operator. The game cartridge has stored in its non-volatile memory 424 the IP address and other data relating to the gaming operator to establish an online connection.

At step 610 various verifications are performed. Because wager gaming is regulated based on jurisdiction (i.e., a geographic location) where either wager gaming is allowed or is not allowed, the geographic location of the user may have to be verified. In the described embodiment, this is done using the IP address of the video game console being used. The IP address can be examined by the gaming operator to determine the geographic location of the console in which the game cartridge was inserted. Preferably, a user attempting to use a game cartridge in a jurisdiction where wager gaming is not allowed by law will not be permitted to continue.

As described above, a game cartridge may have a certificate having an identifier. In the described embodiment, the certificate identifier is transmitted to the gaming operator to ensure that, first, the game cartridge has a certificate and that it is authentic. The gaming operator stores the certificate identifier when the game cartridge is issued to the user.

An identifier for the game DVD or other storage medium is also verified. This may be necessary because the same game cartridge can be used with numerous wager game discs. Thus, a separate verification may be performed on a game disc since verifying the gaming cartridge does not verify the disc. As described in FIG. 3, a game disc identifier is a single unique identifier. In other embodiments, the disc identifier may be a combination of various identifiers stored on the disc. For example, the disc may be issued to a user and intended for use only by that user. In this scenario a user identifier may be stored permanently on the game disc when the user buys it. If a new wager game DVD is inserted, the new DVD is verified before game play begins. In other embodiments, other data are verified at the gaming operator site, such as the user's financial account (e.g., are there sufficient funds in the account to enable wager game play).

At step 612 the gaming operator verifies that the data are accurate. This can be done by checking a database such as database 702 of FIG. 7, storing game cartridge, game console, and related data. If any of the data fail verification, an error message is sent to the game console and displayed on the monitor, for example, a television or a computer monitor. If all the data are successfully verified and accurate, the user can begin entering wager gaming commands and playing the game using the standard game controller, specialized controller, or other input means such as a computer keyboard at step 614. After receiving the commands the game code on the disc and the instructions on the game cartridge make determinations at step 616 on which data are transmitted to the gaming operator, which data are needed from the gaming operator, and what data can remain on the game console as the user begins wager game play.

In addition to the processes described above, a user's monetary accounts are also accessed and managed before and during wager game play. In one embodiment, a user may have to have a minimum dollar balance in a wager account, maintained either by the gaming operator or by a financial institution, such as shown initially in FIG. 1, associated with the gaming operator. In either case, once it is determined that the user has the minimum balance required, which may be set by jurisdictional gaming regulations and/or by the gaming operator, wager game play can begin. Once monetary transactions are made, the gaming operator may be required to keep track of a user's wagering losses and terminate remote wager game play if losses reach a predetermined threshold. This may be a requirement in certain jurisdictions. Once the user terminates a wager game play session using the game console, the monetary accounts are reconciled. The gaming operator may also maintain data on player tracking accounts. A user having a player tracking account with a certain gaming operator can add to that account when engaging in remote wager game play using a game console with that gaming operator. Thus, part of the process described above may involve accessing the user's player tracking account data and updating it as needed during wager game play. Components for accessing and updating player tracking data are described with respect to FIG. 9, describing components of a gaming network. In another embodiment, a user's player tracking account may also be updated in a different manner when the user engages in practice wager game play using the game cartridge and gaming operator's services. Although actual wagering does not take place, a user's loyalty to a particular gaming operator for wager game practice may be shown by keeping track of such data.

As described above with respect to FIGS. 3, 4*a*, and 4*b*, there are various types of data stored on a game cartridge and game disc of the present invention. Similarly, there are various types of data stored and created by a gaming operator. FIG. 7 is a block diagram of a database under control of a gaming operator for storing data used in implementing some embodiments of the present invention.

Although the various data described below in a gaming operator database may reside on one database server 702 as shown in FIG. 7, in other embodiments the data may be distributed over one or more data repositories, storage areas, and various database schemas in a gaming network operated by the gaming operator. Various components of a gaming network may be needed in implementing the actual wager game play and other aspects of the present invention, such as authentication, security, player tracking, and so on. As such, a detailed description of an example gaming network operated and managed by the gaming operator is provided in FIGS. 9 and 10 below.

Access to database 702 and other components in a gaming network may be through one or more Web servers, such as the one shown first in FIG. 1, or through other suitable servers if, for example, a private network is being used. In other embodiments, data described below and shown as stored in database 702 in FIG. 7 may be stored at different physical locations and distributed over a gaming network under control of a gaming operator.

A gaming operator database 702 stores in storage area 704, video game console data 706. These data 706 relate generally to video game consoles, controllers, IP addresses, game disc unique identifiers (which may be organized based on game console manufacturer), and the like. A storage area 708 contains data on specific game console formats that can be used to format game discs or other storage medium for storing wagering game code as described in FIG. 3.

A storage area 711 contains data on game cartridges. As described above, game cartridges are issued to users whose identities, age, address, and so on are verified by the gaming operator. Storage area 711 contains game cartridge and user data 712 associating an issued game cartridge with the issued user. By accessing data 712, a gaming operator can determine the owner of an issued game cartridge or which game cartridge belongs to a particular owner, for example, by examining data in storage area 714. Storage area 711 may also contain data on game discs and purchasers of game discs or this data may be stored in a separate database.

Another category of data is user biometric data. These biometric data 716 are stored in a storage area 718. Biometric data may include enrollment templates (e.g., a fingerprint scan or iris scan) for each user in the system. In one embodiment, the users correspond directly to each person to whom a game cartridge has been issued.

Other types of biometric data may also be stored in area 718. In the described embodiment, the biometric data stored in database 702 and the data received from a game cartridge (the verification template) may be hashed. Using biometric data 716 a gaming operator can take a verification template having a user name and do a one-to-one comparison with data 716 in storage area 718.

As described above, a gaming operator may also act as a certificate authority. Whether it does or not, it may want to store digital certificate data 720 in a storage area 722 in its gaming network. An example digital certificate, such as certificate 432 described in FIG. 4*b*, is shown in greater detail in FIG. 8. In the described embodiment the encryption platform used is PKI, thus, referring now to FIG. 8, a digital certificate 802 is in effect a public key certificate. However, in other platforms or standards, certificate 802 may have other roles depending on whether, for example, DES, 3DES, or AES standards are used. Although the data contained in certificate 802 is shown in a particular order and are labeled, they are an example of one order and description.

An owner name or identifier field 804 corresponds to a name or identifier of the game cartridge. As described above, a game cartridge may be assigned a unique identifier when it is manufactured or assigned to an individual. Related to name/identifier field 804 is identifier/name data field 806 that stores data relating to the owner of the certificate or the device that the certificate belongs to, such as an address or device type, manufacturer, and so on. Public key field 808 contains a public key that the game cartridge makes available to the public so that a third party, such as the gaming operator, can encrypt data intended for the game cartridge. The public key can have a standard length used in PKI, such as 128 bits, 256 bits, or longer.

Also provided on certificate 802 are the name of the certificate authority in a CA name field 810 and the signature of the certificate authority in a CA digital signature field 812. These two fields allow a third party to verify that the certificate is attested to and signed by an entity that the third party trusts, such as IGT. Most certificates are also valid for only a certain time period and have expiration dates. Validity period field 814 stores data relating to the expiration date of certificate 802.

In the described embodiment, a game cartridge connects with a gaming operator via a video game console over the Internet. Once a connection is made with the gaming operator, the user has been identified and authenticated, and the user data such as account and player tracking information has been retrieved, wager game play utilizing the video game console can begin. At this stage the user is in what can be described as a virtual casino and can play electronic gaming machines using a standard or specialized game controller as the user interface. In order for the gaming operator to provide the wager gaming services to the user, it may utilize some aspects of a gaming network, which can be described as the back-end implementation of wager gaming system of the present invention. In one embodiment, database 702 is one component of the gaming network. In another embodiment, the data on database 702 is distributed over various servers and data repositories in the network. For example, the user biometric data 716 may be stored in a special repository better suited for storing such data. The same may be the case of digital certificate data 720, and so on. As described below, in one embodiment, monetary account data and player tracking data are maintained in separate servers in the gaming network. Therefore, it is now useful to provide a detailed description of a gaming network, including its topology, components, including electronic gaming machines and numerous types of servers, and various network devices, that can be used to implement the present invention.

A simplified depiction of a gaming network for implementing certain features of the present invention is shown in FIG. 9. It will be appreciated that other types of networks involving different devices, more or fewer devices, etc., may be used to implement the present invention. For example, as described above, a game provider 905 may provide Internet wagering games, but is not a gaming establishment (such as a casino or the like) that provides on-site wagering games. However, in alternative implementations, game provider 905, such as IGT, may be, or may at least be associated with, such a gaming establishment.

In this example, game provider 905 provides Internet wagering games and related services via one or more servers. In some implementations, the servers may be configured for specialized tasks. For example, server 910 may be primarily configured to provide wager games, server 912 may be primarily configured to provide authentication/identification functions, server 915 may be primarily configured to provide cheating detection services and related countermeasures, server 917 may be primarily configured to provide accounting services, server 920 may be primarily configured to provide financial services, server 925 may be primarily configured to provide progressive and/or bonusing services and server 922 may be primarily configured to provide player tracking services. One of these servers, or another device, may provide additional services such as advertising, network access, licensing, digital key certification, game console verification, biometric data validation, etc.

However, tasks may be apportioned among devices in any convenient fashion. For instance, some or all servers could provide multiple services. In some such implementations, each blade of a blade server provides a separate functionality. Moreover, host device 927 may allow an operator to monitor the activities of game provider 905 and of gaming participants, but may also be involved in some aspects of data analysis/cheating detection or other services. As described in more detail below, players' host devices are preferably involved in some aspects of data gathering and/or analysis.

Telephone 930 allows direct verbal communication between personnel of game provider 905 and others, including gaming participants. Storage devices 937 allow storage of data, including but not limited to accounting and financial data, wager game play data, player data, analyses, game console data, game cartridge data, user biometric data, etc. In some implementations of the invention, storage is provided at another location, e.g., via a storage network. Such storage may, for example, provide data mirroring or other types of redundancy. Preferably, redundant blades, servers and/or other devices provide failover protection.

Firewall 935 is interposed between the devices of game provider 905 and Internet 911. Game provider 905 provides wagering games to players in locations 940 and 970, and to wireless device 980, via Internet 911. In this example, location 940 includes PC 945 and PC 950 and location 970 includes iBook™ 975. Wireless device 990 is a personal digital assistant in this example. Another example relevant to the present invention includes video game consoles.

Gaming establishment 960 is configured for communication with Internet 911 via firewall 965. Gaming establishment 960 may be a casino, a cruise ship, a riverboat or any other type of gaming establishment. Exemplary gaming establishment networks are described in detail below.

Financial institution 985 is also connected to Internet 911, via firewall 990. Financial institution 985 may be a bank, a credit union, a credit card company, or another such institution. Part of the online gaming process may involve the transfer of funds to and/or from network devices of financial institution 985. For example, game provider 905 may also provide account reconciliation services, periodic reports or gaming wins and losses, etc., in connection with financial institution 985.

It will be appreciated that games could be played via devices other than those illustrated in FIG. 9 and that other devices not shown in FIG. 9 may be used within the scope of the invention. For example, some methods and devices described in U.S. patent application Ser. No. 10/991,435, entitled "LOCATION AND USER IDENTIFICATION FOR ONLINE GAMING" and filed on Nov. 3, 2004, which is hereby incorporated by reference, may advantageously be used in connection with the present invention. Such devices include, but are not limited to, location detection devices and biometric devices (such as retinal scanners, hand and/or fingerprint scanners, voice recognition devices and the like).

Moreover, it will be appreciated that one or more networks other than Internet 911 may be used to implement various aspects of the invention, such as a satellite network, a wireless network, a metro optical transport, the PSTN, etc. Accordingly, a variety of protocols may be used for communication, such as Internet Protocol ("IP"), Fibre Channel ("FC"), FC over IP ("FCIP"), Internet SCSI ("iSCSI," an IP-based standard for linking data storage devices over a network and transferring data by carrying SCSI commands over IP networks), Dense Wavelength Division Multiplexing ("DWDM," an optical technology used to increase bandwidth over existing fiber optic backbones), or Code Division Multiple Access (CDMA, a wireless cellular communication technology).

Although illustrative embodiments and applications of this invention are shown and described herein, many variations and modifications are possible which remain within the concept, scope, and spirit of the invention, and these variations would become clear to those of ordinary skill in the art after perusal of this application. Accordingly, the embodiments described are to be considered as illustrative and not restrictive, and the invention is not to be limited to the details given herein, but may be modified within the scope and equivalents of the appended claims.

We claim:

1. A method of playing wagering games over a network utilizing a video game console, the method comprising:

receiving wager game system data over the network from a game cartridge operating through the video game console, the wager game system data including user biometric data, a digital certificate, and a game cartridge identifier, wherein the game cartridge does not include game code for a specific wagering game;

locating user-specific data associated with the wager game system data;

verifying the wager game system data;

receiving a game disc identifier over the network from a game disc operating through the video game console;

verifying the game disc based on the game disc identifier; and transmitting over the network wager game play data to the game console.

2. The method of claim 1 wherein the step of verifying wager game system data further comprises:

comparing the user biometric data with previously-obtained biometric data.

3. The method of claim 1 wherein the step of transmitting further comprises:

encrypting the wager game play data using a public key provided in the digital certificate.

4. The method of claim 1 wherein the wager game play data includes wager game results using a random number generator.

5. The method of claim 1 wherein the step of locating user-specific data further comprises accessing a user monetary account.

6. The method of claim 1 wherein the step of locating user-specific data further comprises accessing user player tracking data.

7. The method of claim 1 wherein the step of receiving further comprises receiving user wager gaming input created during wager game play on the video game console.

8. The method of claim 1, wherein the game disc has a pre-defined format defined by a first entity, and wherein the digital certificate was issued by a second entity.

9. A method of playing wagering games over a network utilizing a video game console, the method comprising:

receiving wager game system data over the network from a game cartridge operating through the video game console, the wager game system data including user biometric data, a game cartridge identifier, and a game identifier, wherein the game cartridge does not include game code for a specific wagering game;

verifying the user biometric data by comparing the user biometric data with initial user registration biometric data;

verifying the game cartridge identifier and the game identifier by cross-referencing a database storing data related to the game cartridge identifier and the game identifier;

receiving a game disc identifier over the network from a game disc operating through the video game console;

verifying the game disc based on the game disc identifier;

authorizing game play of a wager based game for game play on the video game console; and receiving game data from the game cartridge operating through the video game console during game play of the wager based game.

10. The method of claim 9, further comprising determining a geographic location of the video game console.

11. The method of claim 9, further comprising:

receiving an indication that game play of the wager based game has ended, and reconciling monetary account information based on the received game data.

12. The method of claim 9, further comprising updating player tracking data during game play.

13. The method of claim 9, further comprising transmitting over the network game play data to the game console.

* * * * *